US009187206B2

(12) United States Patent
Holley, Jr.

(10) Patent No.: US 9,187,206 B2
(45) Date of Patent: Nov. 17, 2015

(54) CARTON WITH REINFORCED HANDLE

(71) Applicant: Graphic Packaging International, Inc., Atlanta, GA (US)

(72) Inventor: John Murdick Holley, Jr., Lawrenceville, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 74 days.

(21) Appl. No.: 13/768,079

(22) Filed: Feb. 15, 2013

(65) Prior Publication Data

US 2013/0214037 A1 Aug. 22, 2013

Related U.S. Application Data

(60) Provisional application No. 61/633,710, filed on Feb. 16, 2012.

(51) Int. Cl.

| | |
|---|---|
| ***B65D 5/468*** | (2006.01) |
| ***B31B 1/86*** | (2006.01) |
| ***B65D 71/36*** | (2006.01) |

(52) U.S. Cl.

CPC ..... *B65D 5/4608* (2013.01); *B31B 1/86* (2013.01); *B65D 71/36* (2013.01); *B65D 2571/0045* (2013.01); *B65D 2571/00524* (2013.01); *B65D 2571/00882* (2013.01)

(58) Field of Classification Search

CPC .... B65D 5/4208; B65D 5/4608; B65D 71/36; B65D 2571/00882; B65D 2571/0045; B65D 2571/00524; B65D 5/46088; B65D 5/46096; B65D 5/46014; B65D 5/46112; B65D 5/46192; B31D 1/86

USPC ..... 229/117.16, 117.17; 206/427

See application file for complete search history.

(56) References Cited

U.S. PATENT DOCUMENTS

| | | | |
|---|---|---|---|
| 1,253,193 | A | 1/1918 | Hill |
| 2,196,502 | A | 4/1940 | Kells |

(Continued)

FOREIGN PATENT DOCUMENTS

| | | |
|---|---|---|
| CA | 877792 | 8/1971 |
| CA | 2 160 145 | 9/1995 |

(Continued)

OTHER PUBLICATIONS

International Search Report and Written Opinion for PCT/US2013/026283 dated Jun. 10, 2013.

*Primary Examiner* — Gary Elkins

(74) *Attorney, Agent, or Firm* — Wombnle Carlyle Sandridge & Rice, LLP

(57) ABSTRACT

A carton for containing a plurality of articles. The carton comprises a plurality of panels that extends at least partially around an interior of the carton. The plurality of panels comprises a top panel, a bottom panel, a first side panel, and a second side panel. At least two end flaps are respectively foldably attached to respective panels of the plurality of panels, wherein the end flaps are overlapped with respect to one another and thereby at least partially form a closed end of the carton. The carton includes a handle in the closed end of the carton for grasping and carrying the carton. At least one end flap of the at least two end flaps comprises a main panel and a reinforcement flap foldably attached to the main panel. At least a portion of the reinforcement panel is positioned above the handle to reinforce the carton.

32 Claims, 6 Drawing Sheets

(56) References Cited

U.S. PATENT DOCUMENTS

| | | | | |
|---|---|---|---|---|
| 2,308,050 | A | 1/1943 | Burr | |
| 2,383,183 | A | 8/1945 | Fischer | |
| 2,386,905 | A | 10/1945 | Meitzen | |
| 2,594,376 | A | 4/1952 | Arneson | |
| 2,648,484 | A | 8/1953 | Belsinger | |
| 2,702,144 | A | 2/1955 | Forrer | |
| 2,702,155 | A * | 2/1955 | Baumann | 229/117.17 |
| 2,797,856 | A | 7/1957 | Jaeschke | |
| 2,810,506 | A | 10/1957 | Kessler | |
| 2,868,433 | A | 1/1959 | Anderson, Jr. | |
| 2,900,123 | A | 8/1959 | Drnec et al. | |
| 2,955,739 | A | 10/1960 | Collura | |
| 3,112,856 | A | 12/1963 | MacIntosh et al. | |
| 3,127,720 | A | 4/1964 | Gentry et al. | |
| 3,173,596 | A | 3/1965 | Aust et al. | |
| 3,204,815 | A | 9/1965 | Weiss | |
| 3,309,005 | A | 3/1967 | Pilger | |
| 3,334,767 | A | 8/1967 | Cornelius et al. | |
| 3,355,012 | A | 11/1967 | Weiss | |
| 3,381,881 | A | 5/1968 | Granz et al. | |
| 3,756,499 | A | 9/1973 | Giebel et al. | |
| 3,828,926 | A | 8/1974 | Rossi | |
| 3,886,901 | A | 6/1975 | Zeitter | |
| 3,904,036 | A | 9/1975 | Forrer | |
| 3,927,822 | A * | 12/1975 | Giebel | 229/117.17 |
| 3,933,303 | A | 1/1976 | Kirby, Jr. | |
| 3,994,432 | A | 11/1976 | Kirby, Jr. | |
| 4,005,815 | A | 2/1977 | Nerenberg et al. | |
| 4,029,204 | A | 6/1977 | Manizza | |
| 4,036,423 | A | 7/1977 | Gordon | |
| 4,096,985 | A | 6/1978 | Wood | |
| 4,111,306 | A | 9/1978 | Roccaforte | |
| 4,216,861 | A | 8/1980 | Oliff | |
| 4,318,474 | A | 3/1982 | Hasegawa | |
| 4,328,923 | A | 5/1982 | Graser | |
| 4,329,923 | A | 5/1982 | Iida | |
| 4,331,289 | A | 5/1982 | Killy | |
| 4,364,509 | A | 12/1982 | Holley et al. | |
| 4,375,258 | A | 3/1983 | Crayne et al. | |
| 4,378,905 | A | 4/1983 | Roccaforte | |
| 4,382,505 | A | 5/1983 | Sutherland et al. | |
| 4,424,901 | A | 1/1984 | Lanier | |
| 4,440,340 | A | 4/1984 | Bakx | |
| 4,478,334 | A | 10/1984 | Graser | |
| 4,498,619 | A | 2/1985 | Roccaforte | |
| 4,508,258 | A | 4/1985 | Graser | |
| 4,538,759 | A | 9/1985 | Dutcher | |
| 4,545,485 | A | 10/1985 | Oliff | |
| 4,546,914 | A | 10/1985 | Roccaforte | |
| 4,588,084 | A | 5/1986 | Holley, Jr. | |
| 4,621,766 | A | 11/1986 | McClure | |
| 4,653,686 | A | 3/1987 | Wood et al. | |
| 4,706,876 | A | 11/1987 | Wilson | |
| 4,747,487 | A | 5/1988 | Wood | |
| 4,784,266 | A | 11/1988 | Chaussadas | |
| 4,784,316 | A | 11/1988 | Crouch | |
| 4,802,583 | A | 2/1989 | Calvert et al. | |
| 4,830,267 | A | 5/1989 | Wilson | |
| 4,875,586 | A | 10/1989 | Chaussadas | |
| 4,966,324 | A | 10/1990 | Steel | |
| 5,020,337 | A | 6/1991 | Krieg | |
| 5,060,792 | A | 10/1991 | Oliff | |
| 5,072,876 | A | 12/1991 | Wilson | |
| 5,094,359 | A | 3/1992 | DeMars et al. | |
| 5,106,014 | A | 4/1992 | Miller | |
| 5,119,985 | A | 6/1992 | Dawson et al. | |
| 5,197,598 | A | 3/1993 | Stout et al. | |
| 5,221,041 | A | 6/1993 | Stout et al. | |
| 5,222,658 | A | 6/1993 | DeMaio et al. | |
| 5,234,102 | A | 8/1993 | Schuster et al. | |
| 5,246,112 | A | 9/1993 | Stout et al. | |
| 5,284,294 | A | 2/1994 | Floyd | |
| 5,292,058 | A | 3/1994 | Zoss et al. | |
| 5,297,725 | A | 3/1994 | Sutherland | |
| 5,303,863 | A | 4/1994 | Arasim | |
| 5,307,932 | A | 5/1994 | Stout et al. | |
| 5,307,986 | A | 5/1994 | Schuster | |
| 5,320,277 | A | 6/1994 | Stout et al. | |
| 5,333,734 | A | 8/1994 | Stout et al. | |
| 5,350,109 | A | 9/1994 | Brown et al. | |
| 5,379,944 | A | 1/1995 | Stout et al. | |
| 5,381,891 | A | 1/1995 | Harris | |
| 5,385,234 | A | 1/1995 | Stout et al. | |
| 5,395,044 | A | 3/1995 | Stout | |
| 5,427,241 | A | 6/1995 | Sutherland | |
| 5,458,234 | A | 10/1995 | Harris | |
| 5,472,090 | A | 12/1995 | Sutherland | |
| 5,485,915 | A | 1/1996 | Harris | |
| 5,495,727 | A | 3/1996 | Strong et al. | |
| 5,524,756 | A | 6/1996 | Sutherland | |
| 5,551,556 | A | 9/1996 | Sutherland | |
| 5,582,343 | A | 12/1996 | Dalvey | |
| 5,588,585 | A | 12/1996 | McClure | |
| 5,639,017 | A | 6/1997 | Fogle | |
| 5,647,483 | A | 7/1997 | Harris | |
| 5,669,500 | A | 9/1997 | Sutherland | |
| 5,699,957 | A | 12/1997 | Bin et al. | |
| 5,704,470 | A | 1/1998 | Sutherland | |
| 5,738,273 | A | 4/1998 | Auclair | |
| 5,739,273 | A | 4/1998 | Engelman et al. | |
| 5,794,778 | A | 8/1998 | Harris | |
| 5,826,782 | A | 10/1998 | Stout | |
| 5,873,515 | A | 2/1999 | Dunn et al. | |
| 5,878,946 | A | 3/1999 | Frerot et al. | |
| 5,915,546 | A | 6/1999 | Harrelson | |
| 5,992,733 | A | 11/1999 | Gomes | |
| 6,019,276 | A | 2/2000 | Auclair | |
| 6,021,897 | A | 2/2000 | Sutherland | |
| 6,065,590 | A | 5/2000 | Spivey | |
| 6,085,969 | A | 7/2000 | Burgoyne | |
| 6,105,853 | A | 8/2000 | Lamare | |
| 6,105,854 | A | 8/2000 | Spivey et al. | |
| 6,112,977 | A | 9/2000 | Sutherland et al. | |
| 6,131,803 | A | 10/2000 | Oliff et al. | |
| 6,164,526 | A | 12/2000 | Dalvey | |
| 6,170,741 | B1 | 1/2001 | Skolik et al. | |
| 6,227,367 | B1 | 5/2001 | Harrelson et al. | |
| 6,250,542 | B1 | 6/2001 | Negelen | |
| 6,260,755 | B1 | 7/2001 | Bates et al. | |
| 6,302,320 | B1 | 10/2001 | Stout | |
| D452,154 | S | 12/2001 | Rhodes et al. | |
| 6,425,520 | B1 | 7/2002 | Peterson | |
| 6,523,739 | B2 | 2/2003 | Heeley et al. | |
| 6,595,411 | B2 | 7/2003 | McClure | |
| 6,631,803 | B2 | 10/2003 | Rhodes et al. | |
| 6,758,337 | B2 | 7/2004 | Chargueraud et al. | |
| 6,766,940 | B2 | 7/2004 | Negelen | |
| 6,834,793 | B2 | 12/2004 | Sutherland | |
| 6,848,573 | B2 | 2/2005 | Gould et al. | |
| 6,869,009 | B2 | 3/2005 | Sutherland et al. | |
| 6,899,221 | B2 | 5/2005 | Skolik et al. | |
| 6,905,066 | B2 | 6/2005 | Holley et al. | |
| 6,926,193 | B2 | 8/2005 | Smalley | |
| 6,945,450 | B2 | 9/2005 | Rusnock | |
| 6,968,992 | B2 | 11/2005 | Schuster | |
| 7,234,596 | B2 | 6/2007 | Lebras | |
| 7,296,731 | B2 | 11/2007 | Auclair et al. | |
| 7,380,701 | B2 | 6/2008 | Fogle et al. | |
| 7,416,109 | B2 | 8/2008 | Sutherland | |
| 7,427,010 | B2 | 9/2008 | Sutherland | |
| 7,472,791 | B2 | 1/2009 | Spivey, Sr. | |
| 7,601,111 | B2 | 10/2009 | Sutherland et al. | |
| 7,699,215 | B2 | 4/2010 | Spivey, Sr. | |
| 7,743,944 | B2 | 6/2010 | Ho Fung et al. | |
| 7,743,970 | B2 * | 6/2010 | Bates et al. | 229/117.16 |
| 7,748,603 | B2 | 7/2010 | Fogle et al. | |
| 7,757,933 | B2 | 7/2010 | Dunn | |
| 7,775,418 | B2 | 8/2010 | Walling | |
| 7,780,067 | B2 | 8/2010 | Holley, Jr. | |
| 7,806,314 | B2 | 10/2010 | Sutherland | |
| 7,832,622 | B2 | 11/2010 | Spivey, Sr. | |
| 7,854,371 | B2 | 12/2010 | Mittelstaedt | |
| 7,959,062 | B2 | 6/2011 | Auclair | |
| 7,984,843 | B2 | 7/2011 | Cooper et al. | |

(56) References Cited

U.S. PATENT DOCUMENTS

| | | | | |
|---|---|---|---|---|
| 7,998,047 | B2 | 8/2011 | Spivey, Sr. et al. | |
| 8,070,052 | B2 | 12/2011 | Spivey, Sr. et al. | |
| 8,186,569 | B2 | 5/2012 | Kelly | |
| 8,356,743 | B2 | 1/2013 | Spivey, Sr. | |
| 2003/0213263 | A1 | 11/2003 | Woog | |
| 2004/0074954 | A1 | 4/2004 | Fogle et al. | |
| 2005/0056658 | A1 | 3/2005 | Spivey | |
| 2005/0087592 | A1 | 4/2005 | Schuster | |
| 2005/0167478 | A1 | 8/2005 | Holley, Jr. | |
| 2005/0189405 | A1 | 9/2005 | Gomes et al. | |
| 2005/0263574 | A1 | 12/2005 | Schuster | |
| 2006/0071058 | A1 | 4/2006 | Spivey, Sr. | |
| 2006/0081691 | A1 | 4/2006 | Smalley | |
| 2006/0169755 | A1 | 8/2006 | Spivey, Sr. | |
| 2006/0273143 | A1 | 12/2006 | Finch | |
| 2006/0278689 | A1 | 12/2006 | Boshinski et al. | |
| 2007/0039846 | A1 | 2/2007 | Spivey, Sr. | |
| 2007/0051781 | A1 | 3/2007 | Holley, Jr. | |
| 2007/0063003 | A1 | 3/2007 | Spivey et al. | |
| 2007/0108261 | A1 | 5/2007 | Schuster | |
| 2007/0131748 | A1 | 6/2007 | Brand | |
| 2007/0164091 | A1 | 7/2007 | Fogle et al. | |
| 2007/0181658 | A1 | 8/2007 | Sutherland | |
| 2007/0205255 | A1 | 9/2007 | Dunn | |
| 2007/0284424 | A1 | 12/2007 | Holley | |
| 2007/0295789 | A1 | 12/2007 | Ho Fung | |
| 2008/0083820 | A1 | 4/2008 | Walling et al. | |
| 2008/0110967 | A1* | 5/2008 | Walling | 229/117.16 |
| 2008/0119344 | A1 | 5/2008 | Sutherland et al. | |
| 2008/0128479 | A1 | 6/2008 | Bates et al. | |
| 2008/0203143 | A1* | 8/2008 | Holley | 229/117.16 |
| 2008/0257943 | A1 | 10/2008 | Blin | |
| 2009/0212095 | A1 | 8/2009 | Auclair | |
| 2009/0236408 | A1 | 9/2009 | Spivey, Sr. | |
| 2009/0255983 | A1 | 10/2009 | De Paula et al. | |
| 2010/0025457 | A1 | 2/2010 | Cooper et al. | |
| 2010/0044420 | A1 | 2/2010 | Brand | |
| 2010/0213249 | A1 | 8/2010 | Requena | |
| 2013/0092725 | A1* | 4/2013 | Kastanek | 229/117.17 |

FOREIGN PATENT DOCUMENTS

| | | |
|---|---|---|
| DE | 85 14 718.4 | 6/1985 |
| DE | 296 07 374 | 4/1996 |
| DE | 201 12 228 | 11/2002 |
| DE | 2004 018 649 | 4/2005 |
| EP | 0412226 | 2/1991 |
| EP | 0 473 266 | 3/1992 |
| EP | 0870688 | 10/1998 |
| EP | 1 612 157 | 1/2006 |
| FR | 1 494 239 | 9/1967 |
| FR | 2 579 175 | 9/1986 |
| JP | 03039805 | 3/2000 |
| KR | 20-0356729 | 7/2004 |
| WO | WO 96/27538 | 9/1996 |
| WO | WO 99/28198 | 6/1999 |
| WO | WO 99/28207 | 6/1999 |
| WO | WO 00/78618 | 12/2000 |
| WO | WO 01/66434 | 9/2001 |
| WO | WO 03/037742 | 5/2003 |
| WO | WO 2005/080218 | 9/2005 |
| WO | WO 2005/123532 | 12/2005 |
| WO | WO 2006/135918 | 12/2006 |
| WO | WO 2007/089282 | 8/2007 |

* cited by examiner

CARTON WITH REINFORCED HANDLE

CROSS-REFERENCE TO RELATED APPLICATIONS

This application claims the benefit of U.S. Provisional Patent Application No. 61/633,710, filed Feb. 16, 2012.

INCORPORATION BY REFERENCE

The disclosure of U.S. Provisional Patent Application No. 61/633,710, which was filed on Feb. 16, 2012, is hereby incorporated by reference for all purposes as if presented herein in its entirety, for all purposes.

BACKGROUND OF THE DISCLOSURE

The present disclosure generally relates to cartons for holding beverage containers or other types of articles. More specifically, the present disclosure relates to cartons having a reinforced handle.

SUMMARY OF THE DISCLOSURE

In general, one aspect of the disclosure is directed to a carton for containing a plurality of articles. The carton comprises a plurality of panels that extends at least partially around an interior of the carton. The plurality of panels comprises a top panel, a bottom panel, a first side panel, and a second side panel. At least two end flaps are, respectively foldably attached to respective panels of the plurality of panels, wherein the at least two end flaps are overlapped with respect to one another and thereby at least partially form a closed end of the carton. The carton includes a handle in the closed end of the carton for grasping and carrying the carton. At least one end flap of the at least two end flaps comprises a main panel for closing the closed end of the carton and a reinforcement flap foldably attached to the main panel. At least a portion of the reinforcement flap is positioned above the handle to reinforce the carton.

In another aspect, the disclosure is generally directed to a blank for forming a carton for containing a plurality of articles. The blank comprises a plurality of panels for at least partially forming an interior of the carton formed from the blank. The plurality of panels comprises a top panel, a bottom panel, a first side panel, and a second side panel. At least two end flaps are respectively foldably attached to respective panels of the plurality of panels, wherein the at least two end flaps are for being overlapped with respect to one another and thereby at least partially form a closed end of the carton formed from the blank. The blank includes handle features for forming a handle in the closed end of the carton formed from the blank. At least one end flap of the at least two end flaps comprises a main panel for closing the closed end of the carton formed from the blank and a reinforcement flap foldably attached to the main panel. At least a portion of the reinforcement flap is for being positioned above the handle to reinforce the carton formed from the blank.

In yet another aspect, the disclosure is generally directed to a method of forming a carton for containing a plurality of articles. The method comprises obtaining a blank comprising a plurality of panels comprising a top panel, a bottom panel, a first side panel, and a second side panel, at least two end flaps respectively foldably attached to respective panels of the plurality of panels, and handle features. At least one end flap of the at least two end flaps comprises a main panel and a reinforcement flap foldably attached to the main panel. The method includes positioning the reinforcement flap so that the main panel at least partially overlaps the reinforcement flap, and at least partially forming an interior of the carton by positioning the plurality of panels to form a generally open-ended sleeve. The method further comprises at least partially overlapping the at least two end flaps with respect to one another to at least partially form a closed end of the carton, and forming a handle from the handle features in the closed end of the carton. At least a portion of the reinforcement flap is disposed above the handle to reinforce the carton.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENT

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "inner," "outer," "lower," "bottom," "upper," and "top" indicate orientations determined in relation to fully erected and upright cartons.

Figure 1:
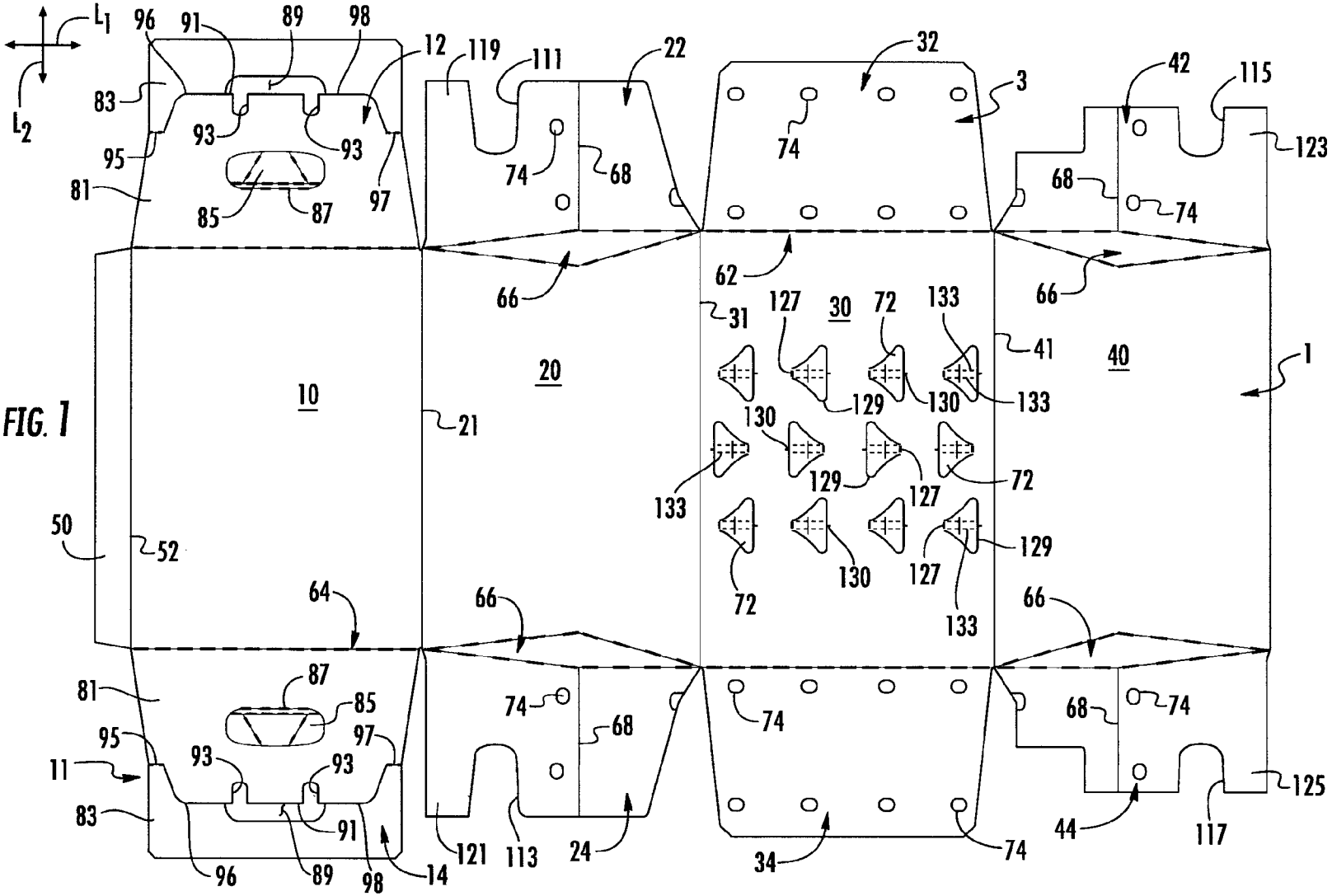
FIG. 1 is a plan view of an exterior surface of a blank for forming a carton according to an exemplary embodiment of the disclosure.

FIG. 1 is a plan view of the exterior side 1 of a blank, generally indicated at 3, used to form a carton 5 (FIG. 3) according to the exemplary embodiment of the disclosure.

The carton 5 can be used to house a plurality of articles such as containers (not shown). In the illustrated embodiment, the carton 5 is sized to house twenty-four containers C in a single layer in a 4×6 arrangement, but it is understood that the carton 5 may be sized and shaped to hold containers of a different or same quantity in more than one layer and/or in different row/column arrangements (e.g., 1×6, 3×6, 3×5, 2×6×2, 3×4×2, 2×9, 2×6, 3×4, etc.). In the illustrated embodiment, the carton 5 includes a handle, generally indicated at 11 (FIGS. 3-6), for grasping and carrying the carton. As will be discussed below in more detail, the handle 11 is formed from various features in the blank 3.

The blank 3 has a longitudinal axis L1 and a lateral axis L2. In the illustrated embodiment, the blank 3 comprises a top panel 10 foldably connected to a first side panel 20 at a first lateral fold line 21, a bottom panel 30 foldably connected to the first side panel 20 at a second lateral fold line 31, and a second side panel 40 foldably connected to the bottom panel at a third lateral fold line 41. In the illustrated embodiment, the blank 3 includes an adhesive flap 50 foldably connected to the top panel 10 at a fourth lateral fold line 52.

The top panel 10 is foldably connected to a first top end flap 12 and a second top end flap 14. The first side panel 20 is foldably connected to a first side flap 22 and a second side flap 24. The bottom panel 30 is foldably connected to a first bottom end flap 32 and a second bottom end flap 34. The second side panel 40 is foldably connected to a first side flap 42 and a second side flap 44. When the carton 5 is erected, the top and bottom end flaps 12 and 32 and side end flaps 22 and 42 close a first end 51 of the carton, and the top and bottom end flaps 14 and 34 and side end flaps 24 and 44 close a second end of the carton. Only the first end 51 of the carton 5 is shown in FIGS. 3-6, but it is understood that the second end of the carton is closed in a substantially similar manner. In accordance with an alternative embodiment of the present disclosure, different flap arrangements can be used for closing the first end 51 and the second end of the carton 5.

The top and bottom end flaps 12 and 32 and side end flaps 22 and 42 extend along a first marginal area of the blank 3, and are foldably connected at a first longitudinal fold line 62 that extends along the length of the blank. The top and bottom end flaps 14 and 34 and side end flaps 24 and 44 extend along a second marginal area of the blank 3, and are foldably connected at a second longitudinal fold line 64 that also extends along the length of the blank. The longitudinal fold lines 62, 64 may be, for example, substantially straight, or offset at one or more locations to account for blank thickness or for other factors. In one embodiment, the side panels 20, 40 include diamond corner panels 66 that allow the closed ends 51 to be configured with a lower portion that is farther from the center of the carton than a top portion of the closed ends. Additionally, a transverse fold line 68 can extend across each of the side end flaps 22, 24, 42, 44 from the respective diamond corner panel 66 to further help the top portions of the respective closed ends extend at an angle with respect to the lower portions (e.g., so that the top portions are inwardly inclined while the lower portions are generally vertical). Such a configuration accommodates the carton 5 having a two-sided taper and a bottom panel 30 with a length greater than the length of the top panel 10. The carton 5 could be otherwise configured such as having a three-sided taper, four-sided taper, or being substantially rectangular parallelepiped shaped with the side panels 20, 40 and closed ends being substantially perpendicular to the bottom panel 30 without departing from the disclosure. For example, in an alternative embodiment, the transverse fold lines 68 could extend across one or both of the respective side panels 20, 40 so that a top portion of the side panels could be inwardly inclined with respect to a lower portion of the respective side panels for a carton with a four-sided taper.

In one embodiment, the first end 51 and the second end of the carton 5 each have article protection features 74 (FIGS. 3 and 4) for protecting at least one of the containers in the carton 5. Additionally, the carton 5 of the first embodiment may have article protection flaps 72 for protecting the containers. The article protection features 74 can help cushion the ends of the carton and prevent or reduce the likelihood of breakage of the containers. In one embodiment, the article protection flaps 72 are movable between a first position (FIG. 1) and a second position (not shown) placed between adjacent containers in the carton to reduce movement of the containers in the carton and prevent breakage of the containers. The article protection features and flaps can be similar to, or the same as, those described in U.S. patent application Ser. No. 13/419,740, filed Mar. 14, 2012, the disclosure of which is herein incorporated by reference. The article protection features 74 and/or the article protection flaps 72 can be otherwise shaped, arranged, and/or configured without departing from the disclosure. Further, the article protection features 74 and/or article protection flaps 72 can be omitted without departing from the disclosure.

As shown in FIG. 1, the side end flaps 22, 24, 42, 44 can have deformations in the form of indentations 74 on the exterior surface 1 of the carton blank 3 such that the indentations from a protrusion on the interior surface of the blank. The bottom end flaps 32, 34 each have two rows of deformations in the form of indentations 74 on the interior surface of the carton blank 3 such that the indentations on the interior surface form a protrusion on the exterior surface 1 of the carton blank 3. The article protection features 74 in the side end flaps 22, 42 and 24, 44 can be generally aligned with respective article protection features 74 in the respective bottom end flaps 32, 34 so that the article protection features cooperate to provide cushioning for the containers in the carton 5. The indentations 74 can be any deformation on a surface of a respective side end flap 22, 24, 42, 44 or bottom end flap 32, 34 such that the deformation can be any suitable shape (e.g., a concave depression or protrusion, convex depression or protrusion, flat depression or protrusion, embossed area, debossed area, etc., or any other suitable shape). Furthermore, the indentations 74 could be formed on the interior or exterior surface of one or more of the first side panel 20, second side panel 40, top panel 10, bottom panel 30, and/or top end flaps 12, 14 without departing from the disclosure. The article protection features 74 could be omitted or could be otherwise shaped, arranged, positioned, and/or configured without departing from the disclosure.

In the illustrated embodiment, the carton blank 3 includes twelve article protection flaps 72 arranged in a 3×4 arrangement in the bottom panel 30. Alternatively, the blank could have more or less than twelve article protection flaps, and the flaps could be otherwise arranged in other suitable row/column arrangements or in a random configuration on the bottom panel 30, including a single row or single column configuration, or any other suitable configuration. In other embodiments, the carton blank 3 can include article protection flaps that are different, similar, or identical to other article protection flaps without departing from the disclosure. In the embodiment of FIG. 1, the middle row of article protection flaps 72 are oriented 180 degrees relative to a row of article protection flaps that are closer to the respective longitudinal fold lines 62, 64. In other embodiments, the article protection flaps 72 could be omitted or could be otherwise shaped, arranged, and/or configured without departing from the disclosure.

As shown in FIG. 1, the article protection flaps 72 are each foldably connected to the bottom panel 30 at a respective lateral fold line 127 and are each at least partially defined by a cut 129 in the bottom panel. Alternatively, the cut 129 could comprise other forms of weakening (e.g., a tear line that comprises cut lines separated by breakable nicks, a tear line that is formed by a series of spaced apart cuts, etc.) that allows the article protection flap 72 to be separated from the bottom panel 30 without departing from the disclosure. In one embodiment, a slit or cut 130 extends laterally from a portion of the cut 129 that is opposite to the lateral fold line 127. As shown in FIG. 1, the article protection flap 72 can comprise generally longitudinal fold lines 133 extending from the lateral fold line 127. The fold lines 127, 133 and cuts 129, 131 could be otherwise shaped, arranged, configured, and/or omitted such that the article protection flap 72 has any other suitable shape or configuration without departing from the disclosure.

Figure 2A:
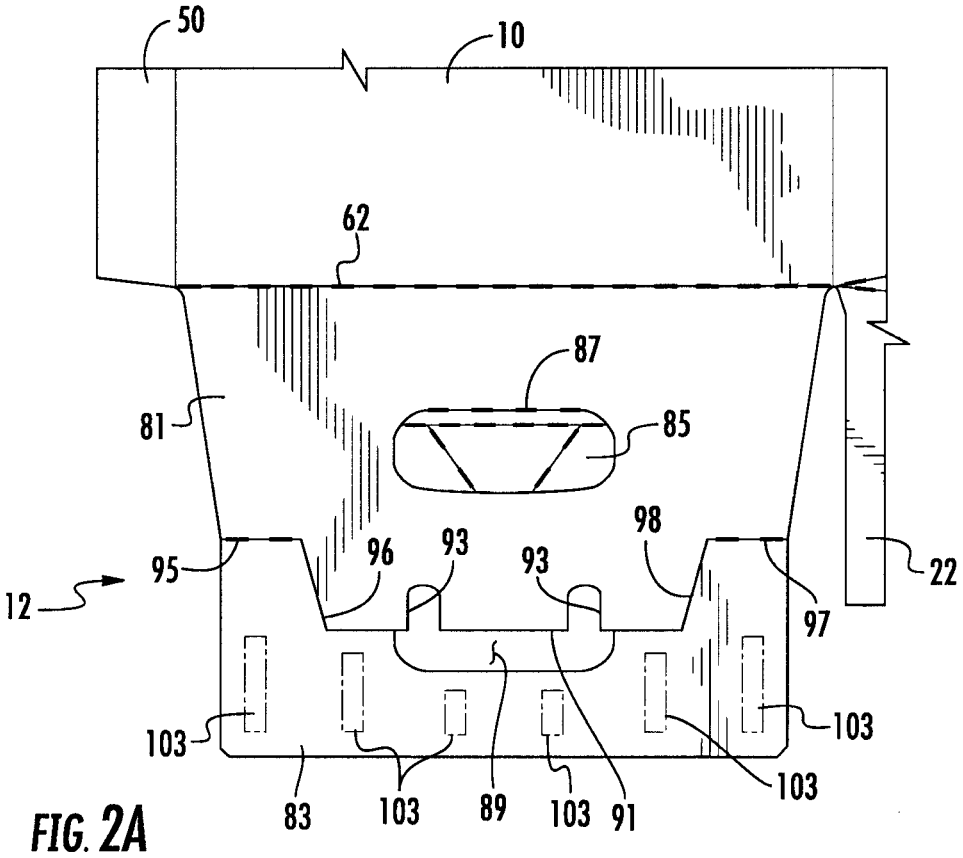
FIG. 2A is a plan view of a top end flap of the blank of FIG. 1.

As shown in FIGS. 1 and 2A, the top end flaps 12, 14 each have a main panel 81 foldably connected to the top panel 10 at respective longitudinal fold line 62, 64 and a reinforcement flap 83 foldably connected to the main panel. The main panel 81 comprises an elongate handle flap 85 foldably connected to the main panel at a longitudinal handle fold line 87. The reinforcement flap 83 has a notch 89 adjacent a free edge 91 of the main panel 81. In the illustrated embodiment, the free edge 91 of the main panel 81 comprises notches 93 that are for accommodating the article protection features 74 in the other end flaps 22, 32, 42 and 24, 34, 44. In the illustrated embodiment, the reinforcement flap 83 is foldably connected to the main panel 81 by spaced apart, longitudinal fold lines 95, 97 and is separable from the main panel 81 along cut lines 96, 98. Alternatively, the cut lines 96, 98 could be tear lines or other features in the top end flaps 12, 14. In one embodiment, the cut lines 96, 98 extend from respective ends of the fold lines 95, 97, and the free edge 91 extends between ends of the cut lines 96, 98. When the reinforcement flap 83 is folded relative the main panel (e.g., FIG. 2B), the free edge 91 extends between respective ends of the fold lines 95, 97. The fold lines 95, 97, the cut lines 96, 98, the free edge 91, and/or the notch 89 could be otherwise shaped, arranged, and/or configured without departing from the disclosure. Additionally, the reinforcement flaps 83, the main panels 81, and/or the handle features could be otherwise shaped, arranged, and/or configured without departing from the disclosure.

As shown in FIG. 1, the side end flaps 22, 24 can have respective notches 111, 113 and the side end flaps 42, 44 at the second end have respective notches 115, 117. When the side end flaps 22, 42 are inwardly folded to close the first end 51 of the carton 5, the notches 111, 113 cooperate to form a handle opening that is generally aligned with the handle flap 85 in the top end flap 12. Similarly, the notches 113, 117 in the side end flaps 24, 44 provide a handle opening generally aligned with the handle flap 85 at the second end of the carton 5. Each of the side end flaps 22, 24 has a respective upper portion 119, 121 adjacent a respective notch 111, 113, and each of the side end flaps 42, 44 has a respective upper portion 123, 125 adjacent a respective notch 115, 117. The upper portions 119, 123 of the side end flaps 22, 42 closing the first end 51 of the carton 5 can be at least partially overlapped and both the upper portions are located above the handle flap 85 in the top end flap 12 when the first end is closed. Similarly, the upper portions 121, 125 of the side end flaps 24, 44 can be at least partially overlapped and both the upper portions are located above the handle flap 85 in the top end flap 14 when the second end is closed. The side end flaps 22, 24, 42, 44 could be otherwise shaped, arranged, and/or configured without departing from the disclosure.

Figure 2B:
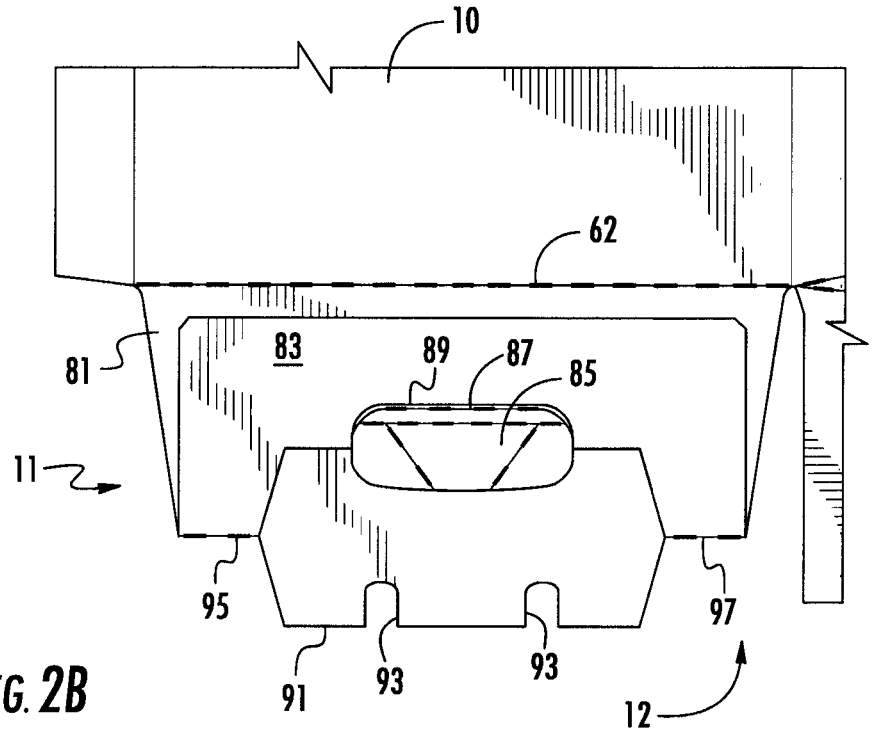
FIG. 2B is a plan view of the top end flap of FIG. 2A after partially assembling the blank into the carton according to the exemplary embodiment of the disclosure.

In one embodiment, the top end flaps 12, 14 can be folded along fold lines 95, 97 prior to forming the blank 3 into the carton 5. Alternatively, one or both of the top end flaps can be folded at any point during or after formation of the carton 5, or the folding of one or both of the top end flaps could be omitted without departing from the disclosure. Only the top end flap 12 at the first end 51 is shown and described, but it is understood that the top end flap 14 in the second end of the carton can be formed in a similar manner as the top end flap 12. As shown in FIG. 2A, glue 103 (e.g., glue strips) or other adhesive is applied to interior surface 101 of the reinforcement flap 83. Additionally, or alternatively, glue can be applied to the main panel 81 without departing from the disclosure. As shown in FIG. 2B, the reinforcement flap 83 can be folded along the fold lines 95, 97 and positioned in face-to-face contact with the interior surface 101 of the main panel 81 so that the glue 103 secures the reinforcement flap 83 to the main panel 81. In the illustrated embodiment, reinforcement flap 83 separates from the main panel 81 along the cut lines 96, 98 while folding along the fold lines 95, 97 so that the free edge 91 of the main panel extends between respective ends of the fold lines 95, 97. The notch 89 of the reinforcement flap 83 can be generally aligned with the handle flap 85 so that at least a portion of the notch 89 is adjacent the handle fold line 87 and the handle flap 85 is disposed between the notch 89 and the fold lines 95, 97. In one embodiment, the notch 89 in the reinforcement flap 83 fits above or closely adjacent to the handle fold line 87 connecting the handle flap 85 to the main panel so a portion of the reinforcement flap is located between the fold line 62 and the handle flap 85. Accordingly, the reinforcement flap 83 is secured to the main panel 81 above the handle flap 85 to help reinforce the handle 11 and the main panel 81. The top end flaps 12, 14 could be otherwise shaped, arranged, and/or configured without departing from the disclosure. For example, in an alternative embodiment, the reinforcement flap 83 could extend generally from the handle fold line 87 to the respective longitudinal fold line 62, 64 and/or over the longitudinal fold line 62, 64. In one embodiment, additional reinforcement material (e.g., reinforcement tape) can be placed on the reinforcement flap 83, the main panel 81, and/or other portions of the blank 3 to provide additional strengthening of the handle 11.

In accordance with the exemplary embodiment, the blank 3 can be erected into the carton 5 by folding along fold lines 21, 31, 41, and 52 and adhering the adhesive flap 50 to the second side panel 40 to form a generally open-ended sleeve (not shown). The blank 3 may be otherwise configured to have multiple top panels and/or multiple bottom panels without departing from the scope of this disclosure. Further, the carton 5 may be a wrap-around type carton, with the blank 3 including locking features that can include primary and secondary locking features as is known in the art.

In the illustrated embodiment, once the blank 3 is formed into the sleeve, the containers may be loaded in the carton 5 from the first end 51 and then the first end may be closed by overlapping and gluing the side end flaps 22, 42 and top and bottom end flaps 12, 32. The second end may be closed by respectively overlapping and gluing the side end flaps 24, 44 and top and bottom end flaps 14, 34. Alternatively, the containers can be loaded from the second end and/or other loading and closing steps may be used without departing from the scope of this disclosure.

Figure 3:
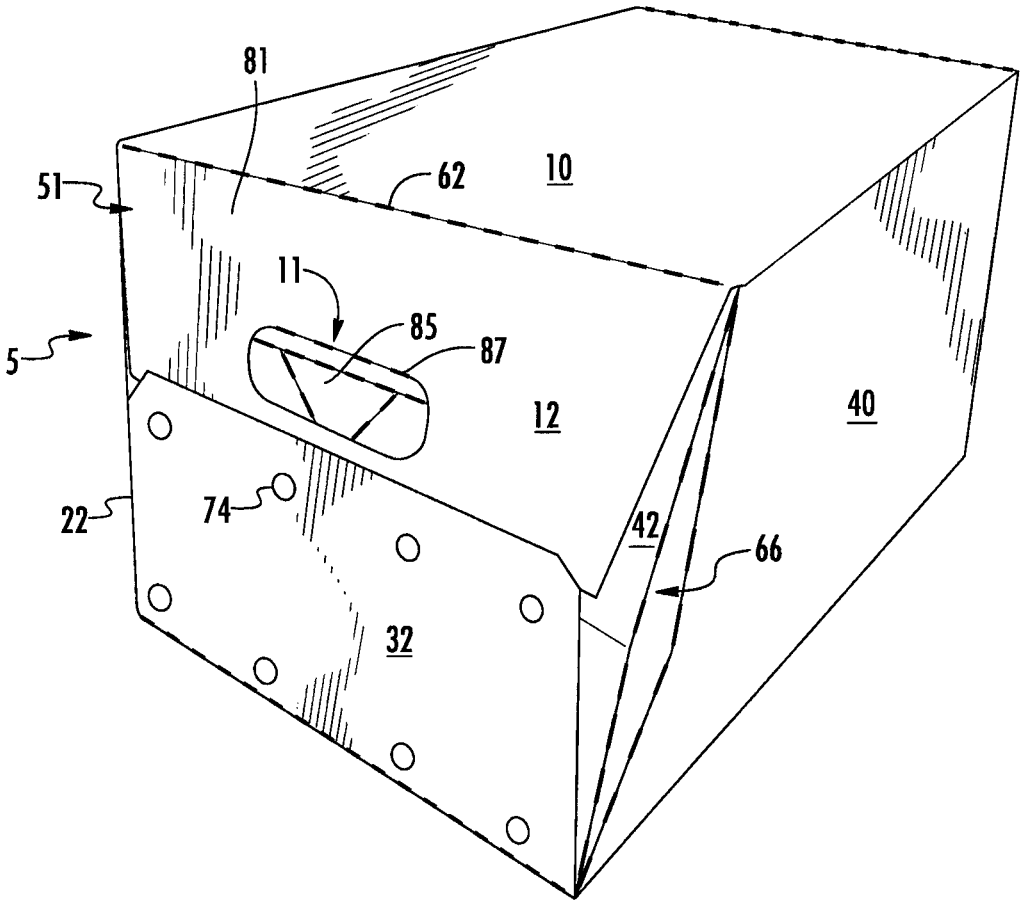
FIG. 3 is a perspective view of the erected carton according to the exemplary embodiment of the disclosure.
Figure 4:
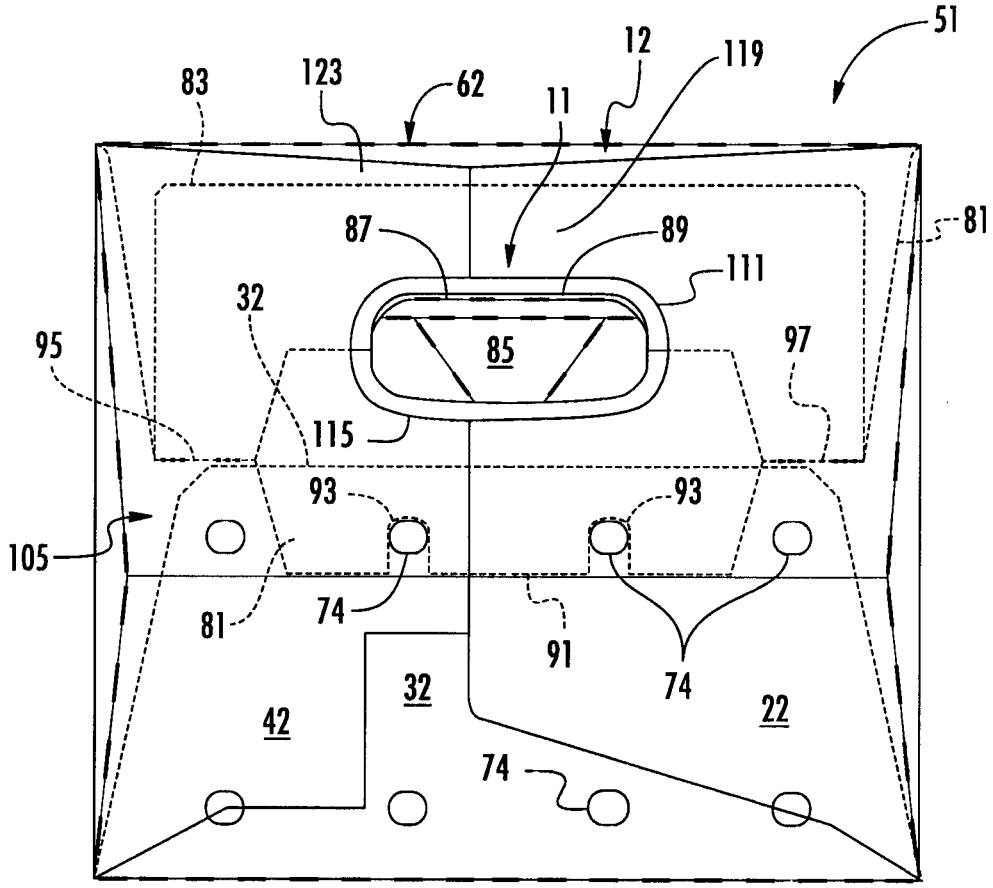
FIG. 4 is a view of a closed end of the carton of FIG. 3 from the interior of the carton with hidden features drawn in phantom.

The erected carton 5 with the closed end 51 and the handle 11 is shown in FIG. 3. FIG. 4 is an interior view of the closed end 51 of the carton 5 from an interior 105 of the carton. Only the first end 51 is shown and described, but it is understood that the second end of the carton 5 can be configured in a similar manner as the first end 51. The hidden lines of the top end flap 12 and the bottom end flap 42 are drawn in phantom in FIG. 4 to show the configuration of the handle and reinforcing features of the closed end 51. Accordingly, the side end flaps 22, 42 are overlapped in the interior of the closed end with the side handle notches 111, 115 generally aligned with the handle flap 85 to provide clearance for folding the handle flap inwardly. The upper portions 119, 123 of the side end flaps 22, 42 are disposed above the handle flap 85. The protection features 74 in the side end flaps 22, 42 are generally aligned with and overlapped by respective protection features 74 in the bottom end flap 32. In the illustrated embodiment, the main panel 81 of the top end flap 12 extends downwardly from the longitudinal fold line 62 to the fold lines 95, 97 and the free edge 91. The notches 93 are generally aligned with protection features 74 in the bottom end flap 32 and the side end flaps 22, 42.

As shown in FIG. 4, the reinforcement flap 83 extends upwardly from the fold lines 95, 97 and is in face-to-face contact with the interior surface of the main panel 81 and the exterior surface of the side end flaps 22, 42 so that the carton 5 includes at least three layers of material above the handle 11, including a portion of each of the main panel 81, the reinforcement flap 83, and the upper portions 119, 123 of the side end flaps 22, 42. The material above the handle can help reinforce the handle and provide a stronger, thicker feel to a user. In the illustrated embodiment, the handle 11 is disposed above the fold lines 95, 97 and the free edge 91 of the main panel 81, and the notch 89 of the reinforcement flap 83 and the upper portions 119, 123 of the side end flaps 22, 42 are disposed above the handle 11. The handle 11 and/or the closed end 51 could be otherwise shaped, arranged, and/or configured without departing from the disclosure.

Figure 5:
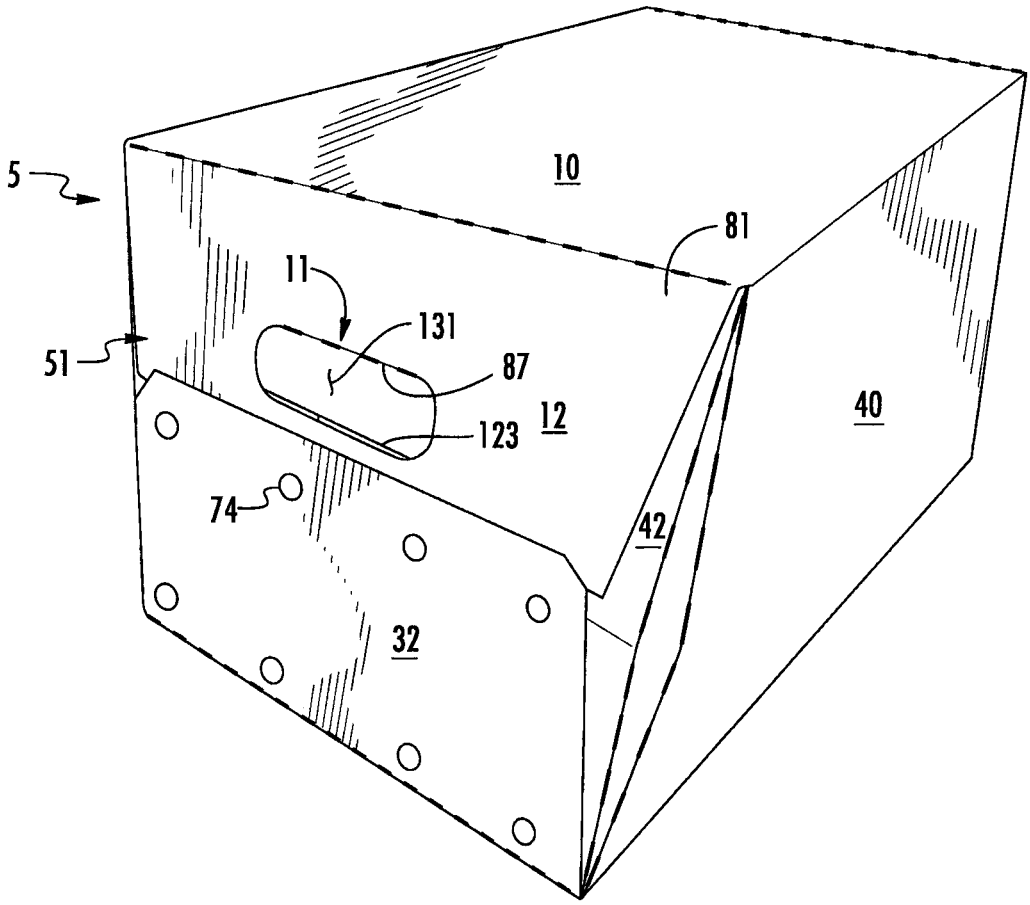
FIG. 5 is a perspective view of the erected carton of FIG. 3 with an activated handle flap according to the exemplary embodiment of the disclosure.
Figure 6:
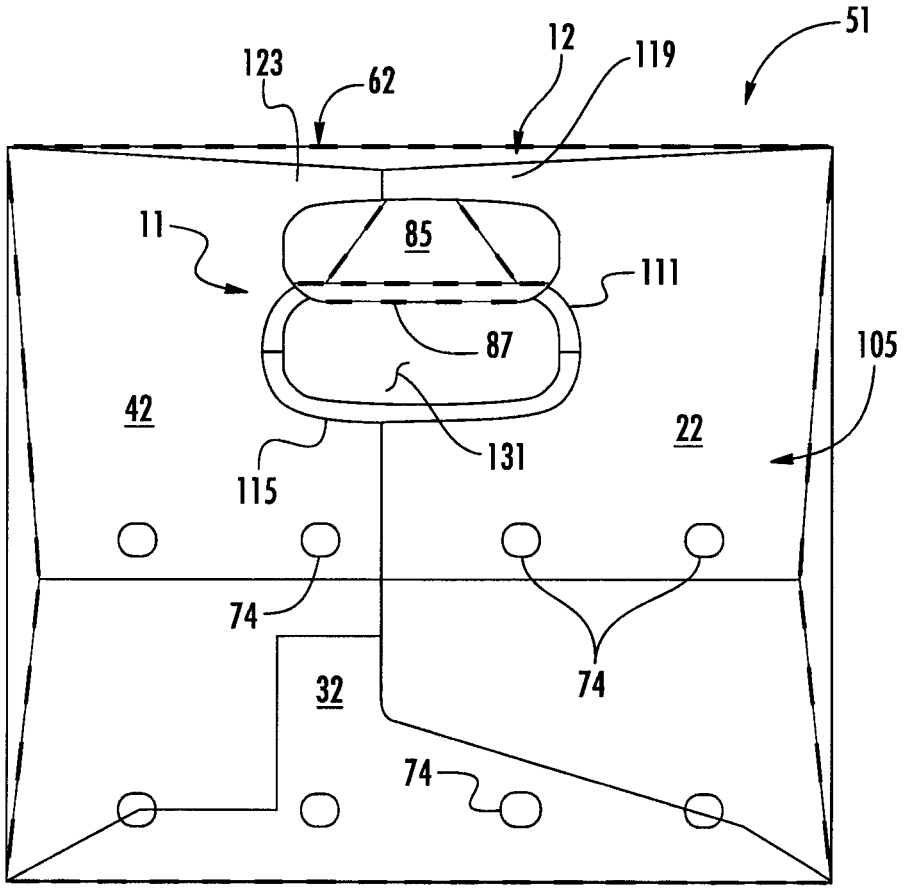
FIG. 6 is a view of the closed end of the carton of FIG. 5 from the interior of the carton with the activated handle.

As shown in FIGS. 5 and 6, the handle 11 is activated for grasping and carrying the carton 5 by pressing the handle flap 85 inwardly and folding the handle flap at the handle fold line 87 so that the handle flap is pressed through the opening created by the notches 111, 115 and 113, 117 in a respective side end flap 22, 42 and 24, 44. When the handle flap 85 is inwardly and upwardly folded, the handle flap can be placed in face-to-face contact with the interior surface of the upper portions 119, 123 or 121, 125 of the respective side end flaps 22, 42 and 24, 44 (FIG. 6). In this way, each handle 11 can comprise four layers of material above the handle opening 131 created by inwardly and upwardly folding the handle flap 85. The four layers of reinforcement material above the handle opening 131 can comprise (in order from the interior of the carton to the exterior) the inwardly and upwardly folded handle flap 85, the upper portions 119, 123 or 121, 125 of the respective side end flaps 22, 42 and 24, 44, the handle reinforcement flap 83, and the main panel 81. The handle 11 can be otherwise arranged and configured to have more or less than four layers of material above the handle opening 131 without departing from the disclosure. Further, any of the features of the handle 11 can be alternatively shaped, arranged, configured, positioned and/or omitted without departing from the disclosure.

In an alternative embodiment, the carton 5 could include additional or alternative features, such as a dispenser comprising a removable dispenser panel or other features without departing from the disclosure.

The blank 3 according to the present disclosure can be, for example, formed from coated paperboard and similar materials. For example, the interior and/or exterior sides of the blank 3 can be coated with a clay coating. The clay coating may then be printed over with product, advertising, price coding, and other information or images. The blank 3 may then be coated with a varnish to protect any information printed on the blank. The blank 3 may also be coated with, for example, a moisture barrier layer, on either or both sides of the blank. In accordance with the above-described embodiments, the blank 3 may be constructed of paperboard of a caliper such that it is heavier and more rigid than ordinary paper. The blank 3 can also be constructed of other materials, such as cardboard, hard paper, or any other material having properties suitable for enabling the carton 5 to function at least generally as described herein. The blank 3 can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising:

a plurality of panels that extends at least partially around an interior of the carton, the plurality of panels comprising a top panel, a bottom panel, a first side panel, and a second side panel;

at least two end flaps respectively foldably attached to respective panels of the plurality of panels, wherein the at least two end flaps are overlapped with respect to one another and thereby at least partially form a closed end of the carton;

a handle in the closed end of the carton for grasping and carrying the carton;

at least one end flap of the at least two end flaps comprises a main panel for closing the closed end of the carton and a reinforcement flap foldably attached to the main panel, at least a portion of the reinforcement flap being positioned above the handle to reinforce the carton, wherein the reinforcement flap is foldably connected to the main panel along at least a first fold line and a second fold line, each of the first fold line and the second fold line being a longitudinal fold line disposed below the handle in the closed end of the carton, and the main panel comprises a free edge extending from an end of the first fold line to an end of the second fold line, the free edge being spaced apart from the handle.

2. The carton of claim 1, wherein the reinforcement flap comprises a notch that is generally aligned with at least a portion of the handle.

3. The carton of claim 2, wherein the handle comprises a handle feature extending in the main panel, the handle feature being disposed between the notch of the reinforcement flap and the free edge of the main panel.

4. The carton of claim 3, wherein the handle feature comprises a handle flap foldably connected to the main panel along a handle fold line extending adjacent the notch of the reinforcement flap.

5. The carton of claim 1, wherein the reinforcement flap is at least partially in face-to-face contact with an interior surface of the main panel.

6. The carton of claim 1, wherein the at least one end flap comprises a top end flap, and the main panel is foldably connected to the top panel.

7. The carton of claim 1, wherein the reinforcement flap is at least partially in face-to-face contact with an interior surface of the main panel, the handle comprises a handle flap foldably connected to the main panel along a handle fold line, and the reinforcement flap comprises a notch that is generally aligned with the handle flap, at least a portion of the handle fold line being adjacent a free edge of the notch.

8. A carton for containing a plurality of articles, the carton comprising:

a plurality of panels that extends at least partially around an interior of the carton, the plurality of panels comprising a top panel, a bottom panel, a first side panel, and a second side panel;

at least two end flaps respectively foldably attached to respective panels of the plurality of panels, wherein the at least two end flaps are overlapped with respect to one another and thereby at least partially form a closed end of the carton;

a handle in the closed end of the carton for grasping and carrying the carton;

at least a first end flap of the at least two end flaps comprises a main panel for closing the closed end of the carton and a reinforcement flap foldably attached to the main panel along at least one fold line, at least a portion of the reinforcement flap being positioned above the handle to reinforce the carton, the at least one fold line being disposed below the handle in the closed end of the carton, and the main panel comprising a free edge adjacent the at least one fold line.

9. A carton for containing a plurality of articles, the carton comprising:

a plurality of panels that extends at least partially around an interior of the carton, the plurality of panels comprising a top panel, a bottom panel, a first side panel, and a second side panel;

at least two end flaps respectively foldably attached to respective panels of the plurality of panels, the at least two end flaps comprising at least a top end flap and a side end flap, the side end flap being foldably connected to the first side panel or the second side panel, wherein the at least two end flaps are overlapped with respect to one another and thereby at least partially form a closed end of the carton;

a handle in the closed end of the carton for grasping and carrying the carton, the handle comprising a handle flap foldably connected to the top end flap and a side notch extending from an edge of the side end flap, the side notch being generally aligned with the handle flap; and the top end flap comprises a main panel foldably connected to the top panel and a reinforcement flap foldably attached to the main panel, at least a portion of the reinforcement flap being positioned above the handle to reinforce the carton.

10. A carton for containing a plurality of articles, the carton comprising:

a plurality of panels that extends at least partially around an interior of the carton, the plurality of panels comprising a top panel, a bottom panel, a first side panel, and a second side panel;

at least two end flaps respectively foldably attached to respective panels of the plurality of panels, wherein the at least two end flaps are overlapped with respect to one another and thereby at least partially form a closed end of the carton;

a handle in the closed end of the carton for grasping and carrying the carton; and at least one end flap of the at least two end flaps comprises a main panel for closing the closed end of the carton and a reinforcement flap foldably attached to the main panel, at least a portion of the reinforcement flap being positioned above the handle to reinforce the carton, wherein the reinforcement flap is foldably connected to the main panel along at least a first fold line and a second fold line, and the main panel comprises a free edge extending from an end of the first fold line to an end of the second fold line, the free edge being spaced apart from the handle;

wherein the reinforcement flap is at least partially in face-to-face contact with an interior surface of the main panel, the handle comprises a handle flap foldably connected to the main panel along a handle fold line, and the reinforcement flap comprises a notch that is generally aligned with the handle flap, at least a portion of the handle fold line being adjacent a free edge of the notch;

wherein the at least two end flaps comprise at least one side end flap foldably connected to at least one of the first side panel and the second side panel, the at least one side end flap comprising a side notch that is generally aligned with the handle flap in the main panel.

11. The carton of claim 10, wherein the at least one side end flap comprises an upper portion adjacent the side notch, the upper portion being at least partially in face-to-face contact with the reinforcement flap above the handle.

12. The carton of claim 11, wherein the handle flap is for being folded inwardly and upwardly along the handle fold line to position the handle flap at least partially in face-to-face contact with the upper portion of the at least one side end flap so that at least four layers of material comprising at least a portion of each of the handle flap, the upper portion, the reinforcement flap, and the main panel are disposed above the handle.

13. A blank for forming a carton for containing a plurality of articles, the blank comprising:

a plurality of panels for at least partially forming an interior of the carton formed from the blank, the plurality of panels comprising a top panel, a bottom panel, a first side panel, and a second side panel;

at least two end flaps respectively foldably attached to respective panels of the plurality of panels, wherein the at least two end flaps are for being overlapped with respect to one another and thereby at least partially form a closed end of the carton formed from the blank;

handle features for forming a handle in the closed end of the carton formed from the blank;

at least one end flap of the at least two end flaps comprises a main panel for closing the closed end of the carton formed from the blank and a reinforcement flap foldably attached to the main panel, at least a portion of the reinforcement flap for being positioned above the handle to reinforce the carton formed from the blank, wherein the reinforcement flap is foldably connected to the main panel along at least one longitudinal fold line, the at least one longitudinal fold line for being disposed below the handle in the closed end of the carton formed from the blank, and the reinforcement flap being at least partially separable from the main panel along at least one cut line adjacent the at least one fold line.

14. The blank of claim 13, wherein the reinforcement flap comprises a notch that is for being generally aligned with at least a portion of the handle when the carton is formed from the blank.

15. The blank of claim 14, wherein the at least one fold line comprises a first fold line and a second fold line, and the at least one cut line comprising a first cut line extending from an end of the first fold line and a second cut line extending from an end of the second fold line.

16. The blank of claim 14, wherein the handle features comprise a handle flap foldably connected to the main panel along a handle fold line, and the reinforcement flap is for being positioned so that the handle is disposed between the notch of the reinforcement flap and a free edge of the main panel and the handle fold line extends adjacent the notch of the reinforcement flap when the carton is formed from the blank.

17. The blank of claim 13, wherein the at least one end flap comprises a top end flap, and the main panel is foldably connected to the top panel.

18. The blank of claim 13, wherein the handle features comprise a handle flap foldably connected to the main panel along a handle fold line, the reinforcement flap is for being disposed at least partially in face-to-face contact with an interior surface of the main panel when the carton is formed from the blank, and the reinforcement flap comprises a notch that is for being generally aligned with the handle flap with at least a portion of the handle fold line adjacent a free edge of the notch when the carton is formed from the blank.

19. The blank of claim 18, wherein the at least two end flaps comprise at least one side end flap foldably connected to at least one of the first side panel and the second side panel, the at least one side end flap comprising a side notch that is for being generally aligned with the handle flap in the main panel when the carton is formed from the blank.

20. The blank of claim 19, wherein the at least one side end flap comprises an upper portion adjacent the side notch, the upper portion being for positioning at least partially in face-to-face contact with the reinforcement flap above the handle when the carton is formed from the blank.

21. The blank of claim 20, wherein the handle flap is for being folded inwardly and upwardly along the handle fold line so that at least four layers of material comprising at least a portion of each of the handle flap, the upper portion, the reinforcement flap, and the main panel are disposed above the handle when the carton is formed from the blank.

22. A blank for forming a carton for containing a plurality of articles, the blank comprising:

a plurality of panels for at least partially forming an interior of the carton formed from the blank, the plurality of panels comprising a top panel, a bottom panel, a first side panel, and a second side panel;

at least two end flaps respectively foldably attached to respective panels of the plurality of panels, wherein the at least two end flaps are for being overlapped with respect to one another and thereby at least partially form a closed end of the carton formed from the blank;

handle features for forming a handle in the closed end of the carton formed from the blank;

at least one end flap of the at least two end flaps comprises a main panel for closing the closed end of the carton formed from the blank and a reinforcement flap foldably attached to the main panel, at least a portion of the reinforcement flap for being positioned above the handle to reinforce the carton formed from the blank, wherein the reinforcement flap is foldably connected to the main panel along at least a first fold line and a second fold line, the reinforcement flap being at least partially separable from the main panel along at least a first cut line extending from an end of the first fold line and a second cut line extending from an end of the second fold line;

wherein the reinforcement flap comprises a notch that is for being generally aligned with at least a portion of the handle when the carton is formed from the blank, and the main panel comprises a free edge extending from a first end of the first cut line to a second end of the second cut line, the free edge being adjacent the notch of the reinforcement flap.

23. The blank of claim 22, wherein:

the at least one end flap is a first end flap, and the at least two end flaps comprise at least a second end flap; and the second end flap comprises at least one protection feature; and the main panel comprises at least one protection feature notch adjacent the free edge of the main panel, the at least one protection feature notch for being generally aligned with the at least one protection feature in the second end flap when the carton is formed from the blank.

24. A blank for forming a carton for containing a plurality of articles, the blank comprising:

a plurality of panels for at least partially forming an interior of the carton formed from the blank, the plurality of panels comprising a top panel, a bottom panel, a first side panel, and a second side panel;

at least two end flaps respectively foldably attached to respective panels of the plurality of panels, wherein the at least two end flaps are for being overlapped with respect to one another and thereby at least partially form a closed end of the carton formed from the blank;

handle features for forming a handle in the closed end of the carton formed from the blank; and at least one end flap of the at least two end flaps comprises a main panel for closing the closed end of the carton formed from the blank and a reinforcement flap foldably attached to the main panel, at least a portion of the reinforcement flap for being positioned above the handle to reinforce the carton formed from the blank;

wherein the at least one end flap comprises a top end flap, and the main panel is foldably connected to the top panel;

wherein the at least two end flaps comprise at least one side end flap foldably connected to at least one of the first side panel and the second side panel, the handle features comprise a handle flap in the main panel, and the at least one side end flap comprises a side notch that is for being generally aligned with the handle flap in the main panel.

25. A method of forming a carton for containing a plurality of articles, the method comprising:

obtaining a blank comprising a plurality of panels comprising a top panel, a bottom panel, a first side panel, and a second side panel, at least two end flaps respectively foldably attached to respective panels of the plurality of panels, and handle features, wherein at least one end flap of the at least two end flaps comprises a main panel and a reinforcement flap foldably attached to the main panel, wherein the reinforcement flap is foldably connected to the main panel along at least one longitudinal fold line, the reinforcement panel being at least partially separable from the main panel along at least one cut line adjacent the at least one fold line;

positioning the reinforcement flap so that the main panel at least partially overlaps the reinforcement flap;

at least partially forming an interior of the carton by positioning the plurality of panels to form a generally open-ended sleeve;

at least partially overlapping the at least two end flaps with respect to one another to at least partially form a closed end of the carton; and forming a handle from the handle features in the closed end of the carton, wherein at least a portion of the reinforcement flap is disposed above the handle to reinforce the carton, and the at least one longitudinal fold line is disposed below the handle in the closed end of the carton.

26. The method of claim 25, wherein the positioning the reinforcement flap comprises folding the reinforcement flap into at least partially face-to-face contact with the main panel.

27. The method of claim 26, wherein the handle comprises a handle flap foldably connected to the main panel along a handle fold line, the reinforcement flap comprises a notch, and the positioning the reinforcement flap comprises generally aligning the notch with the handle flap so that at least a portion of the handle fold line is adjacent the notch.

28. The method of claim 27, wherein the at least two end flaps comprise at least one side end flap foldably connected to at least one of the first side panel and the second side panel, the at least one side end flap comprises a side notch, and the forming the handle further comprises at least partially aligning the side notch with the handle flap in the main panel.

29. The method of claim 28, wherein the at least one side end flap comprises an upper portion adjacent the side notch, and the forming the handle further comprises positioning the upper portion at least partially in face-to-face contact with the reinforcement flap above the handle.

30. The method of claim 29, further comprising forming a handle opening by folding the handle flap along the handle fold line and positioning the handle flap at least partially in face-to-face contact with the upper portion of the at least one side end flap so that at least four layers of material comprising at least a portion of each of the handle flap, the upper portion, the reinforcement flap, and the main panel are disposed above the handle.

31. A method of forming a carton for containing a plurality of articles, the method comprising:

obtaining a blank comprising a plurality of panels comprising a top panel, a bottom panel, a first side panel, and a second side panel, at least two end flaps respectively foldably connected to respective panels of the plurality of panels, and handle features, wherein the at least two end flap comprise at least a first end flap and a second end flap, the first end flap comprises a main panel and a reinforcement flap foldably connected to the main panel along at least one fold line;

positioning the reinforcement flap so that the main panel at least partially overlaps the reinforcement flap;

at least partially forming an interior of the carton by positioning the plurality of panels to form a generally open-ended sleeve;

at least partially overlapping the at least two end flaps with respect to one another to at least partially form a closed end of the carton; and forming a handle from the handle features in the closed end of the carton, wherein at least a portion of the reinforcement flap is disposed above the handle to reinforce the carton and the at least one fold line is disposed below the handle in the closed end of the carton.

32. A method of forming a carton for containing a plurality of articles, the method comprising:

obtaining a blank comprising a plurality of panels comprising a top panel, a bottom panel, a first side panel, and a second side panel, at least two end flaps respectively foldably connected to respective panels of the plurality of panels, and handle features comprising a handle flap and a side notch, wherein the at least two end flaps comprise at least a top end flap and at least one side end flap, the top end flap comprising a main panel foldably connected to the top panel and a reinforcement flap foldably connected to the main panel, the handle flap is foldably connected to the main panel, and the side end flap comprises the side notch and is foldably connected to at least one of the first side panel and the second side panel;

positioning the reinforcement flap so that the main panel at least partially overlaps the reinforcement flap;

at least partially forming an interior of the carton by positioning the plurality of panels to form a generally open-ended sleeve;

at least partially overlapping the at least two end flaps with respect to one another to at least partially form a closed end of the carton; and forming a handle from the handle features in the closed end of the carton, wherein at least a portion of the reinforcement flap is disposed above the handle to reinforce the carton, the forming the handle further comprising at least partially aligning the side notch in the at least one side end flap with the handle flap in the main panel.

* * * * *